US007628220B2

(12) United States Patent
Barezzani et al.

(10) Patent No.: US 7,628,220 B2
(45) Date of Patent: Dec. 8, 2009

(54) IMPACT MOTORIZED WRENCH

(75) Inventors: Gualtiero Barezzani, Brescia (IT); Gianpaolo Luciani, Brescia (IT); Gianfranco Musoni, Brescia (IT)

(73) Assignee: Cembre S.p.A., Brescia (IT)

( * ) Notice: Subject to any disclaimer, the term of this patent is extended or adjusted under 35 U.S.C. 154(b) by 154 days.

(21) Appl. No.: 11/579,609

(22) PCT Filed: May 20, 2004

(86) PCT No.: PCT/IT2004/000290

§ 371 (c)(1), (2), (4) Date: Jul. 3, 2007

(87) PCT Pub. No.: WO2005/113200

PCT Pub. Date: Dec. 1, 2005

(65) Prior Publication Data

US 2008/0277129 A1 Nov. 13, 2008

(51) Int. Cl.
*B25B 21/02* (2006.01)

(52) U.S. Cl. ..... 173/104; 173/93; 173/109; 173/114; 173/171

(58) Field of Classification Search ..... 173/104, 173/93, 109, 114, 171
See application file for complete search history.

(56) References Cited

U.S. PATENT DOCUMENTS

| | | | | |
|---|---|---|---|---|
| 2,342,783 | A | 2/1944 | Aron et al. | |
| 3,152,650 | A | 10/1964 | Savidge | |
| 3,696,693 | A * | 10/1972 | Bosten et al. | 81/464 |
| 3,876,014 | A * | 4/1975 | Moores, Jr. | 173/47 |
| 4,282,652 | A | 8/1981 | Ballas, Sr. | |
| 4,538,484 | A | 9/1985 | Hardy et al. | |

(Continued)

FOREIGN PATENT DOCUMENTS

GB 2 010 156 A 7/1979

(Continued)

*Primary Examiner*—Brian D Nash
(74) *Attorney, Agent, or Firm*—Dickstein Shapiro LLP

(57) ABSTRACT

An impact motorized wrench includes a tool-holder shaft arranged on a front side of the wrench and pivoting around a rotation axis, a rotary motion producing motor unit arranged on a rear side of the wrench opposite the front side and an operating member to operate the motor unit, a drive unit with a percussion mechanism being arranged between the motor unit and the tool-holder shaft. The motor unit, the drive unit and the percussion mechanism together form a base body of the wrench and the wrench includes two gripping handles attached to the base body, both being of elongated shape and transversally spaced apart relative to their longitudinal extensions. The handles define a common gripping plane tangential to both handles, which plane extends transversally to the rotation axis. The operating member is associated to one of the two handles.

33 Claims, 4 Drawing Sheets

U.S. PATENT DOCUMENTS

| | | | | |
|---|---|---|---|---|
| 4,641,714 | A | 2/1987 | Ferioli | |
| 4,719,976 | A * | 1/1988 | Bleicher et al. | 173/109 |
| 4,766,963 | A * | 8/1988 | Hartwig et al. | 173/109 |
| 4,977,966 | A | 12/1990 | Farber et al. | |
| 5,245,757 | A | 9/1993 | Schierling et al. | |
| 5,996,707 | A * | 12/1999 | Thome et al. | 173/2 |
| 6,000,310 | A * | 12/1999 | Shilkrut et al. | 83/615 |
| 6,082,087 | A | 7/2000 | Tada et al. | |
| 6,112,831 | A | 9/2000 | Gustafsson | |
| 6,273,601 | B1 | 8/2001 | Hlavka et al. | |
| 6,415,875 | B1 * | 7/2002 | Meixner et al. | 173/2 |
| 6,923,271 | B2 * | 8/2005 | Frauhammer et al. | 173/132 |
| 7,073,606 | B2 * | 7/2006 | Mamber et al. | 173/93.5 |
| 2003/0116332 | A1 * | 6/2003 | Nadig et al. | 173/48 |
| 2003/0116333 | A1 * | 6/2003 | Voulkidis et al. | 173/104 |
| 2006/0081387 | A1 * | 4/2006 | Reed | 173/109 |

FOREIGN PATENT DOCUMENTS

| | | |
|---|---|---|
| WO | WO 02/34486 A | 5/2005 |

* cited by examiner

IMPACT MOTORIZED WRENCH

FIELD OF INVENTION

The object of the present invention is a portable impact motorized wrench, as well as a handle for such wrench. The invention relates particularly to wrenchs with internal combustion motors separate from an outer source of electrical or pneumatical energy.

These wrenchs can be used for many applications, mainly for the building and maintenance of railway lines and also for mounting wheels on trucks.

BACKGROUND OF THE INVENTION

In the railway building sector two major applications can be identified:

providing the rail joints by means of drilled tie plates arranged on both sides of the drilled web of two adjacent rails and screwed by means of horizontal bolts, such as to form the continuous rail level. This application requires a horizontal screwing or unscrewing operation from the rail side in a narrow operating space due to the bulky presence of the ties and the ballast consisting of either pebble gravel or concrete.

The anchorage of the rail couplings to the ties is carried out by means of vertical screws. This application requires a vertical screwing or unscrewing operation from above.

The mounting or dismounting of the truck wheels consists in screwing or unscrewing the wheel locking nuts while being in the horizontal position.

Since the above operations are niche applications, the tools known so far for carrying out these operations are substantially similar to motor-driven tools developed for other applications on a larger scale, such as the gun-handle wrenchs for use in the metal carpentry constructions and in the mass-produced mechanical constructions, bush-cutters and chain saws.

This entails drawbacks due to the dimensions and positioning of the wrench, the resulting reaction moment performed by the user, as well as the work posture which the latter is forced to take.

The one-hand handle of the gun-type is not suitable for the great moments required by railway applications.

The wrenchs manufactured based on bush-cutters have two separate handles, differently spaced apart from the motor axis and arranged such as to be staggered in the direction of the motor axis. This configuration, together with the bulk of the motor unit itself does not allow the horizontal use for making the rail joints. Furthermore, the mutual arrangement of the handles and their location relative to the motor axis entail that reaction moment performed by the user acts around an inclined axis relative to the motor axis and the "deviating" parts of the reaction moment cause a mispositioning of the tool and an unhealthy posture by the user.

The wrenchs manufactured based on chain saws have only one handle perpendicular to the motor axis and integrally formed in the plastic housing of the wrench also defining the tank. In some cases a further handle is provided, also perpendicular to the motor axis and staggered relative to the first handle along said motor axis. A wrench of this kind is described and illustrated in the German utility model G 88 05 367. With this configuration, the user is forced to work in an ergonomically incorrect position and the fixed gripping positions, i.e. of the hands, relative to the rotation axis, require a notable effort to resist to the screwing/unscrewing torque. In the case where the accelerator button (arranged in the first handle) is operated with the forefinger, the user's posture will be further worsened. On the contrary, by using the thumb to operate the accelerator button, the user's posture will be improved but the gripping capacity of his hand will be compromised.

Furthermore, the fact that both the handle and the tank are integrally formed in the plastic housing of the wrench limits on the one hand the volumetric capacity of the tank, and consequently the wrench autonomy of operation, and on the other hand it exposes the handle (which is fragile) to knocks and damages.

Therefore, the object of the present invention is to devise an impact motorized wrench with such characteristics as to overcome the drawbacks cited with reference to the prior art.

SUMMARY OF THE INVENTION

This object is achieved by an impact motorized wrench according to claim 1 as well as by a gripping frame for a motorized wrench according to claim 34 and a screwing and unscrewing system for rails according to claim 33.

BRIEF DESCRIPTION OF THE DRAWINGS

In order to better understand the present invention and appreciate the advantages thereof, an embodiment thereof will be described below by way of a non limiting example, with reference to the annexed figures, wherein.

DETAILED DESCRIPTION OF PREFERRED EMBODIMENTS

Figure 1:
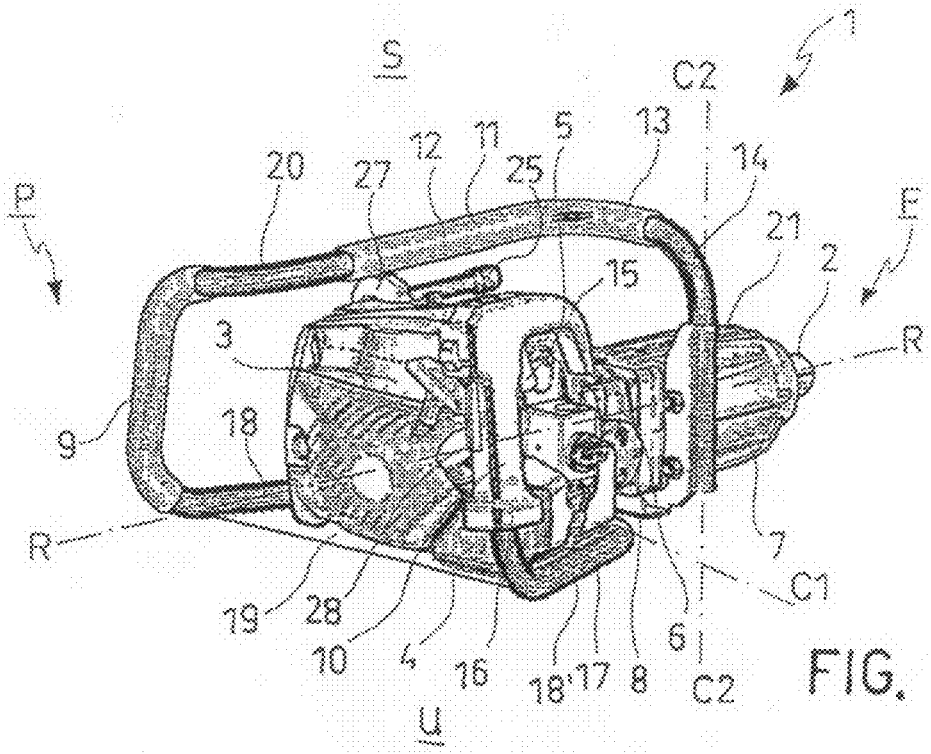
FIGS. 1 and 2 are perspective views of a motorized wrench according to the invention.
Figure 2:
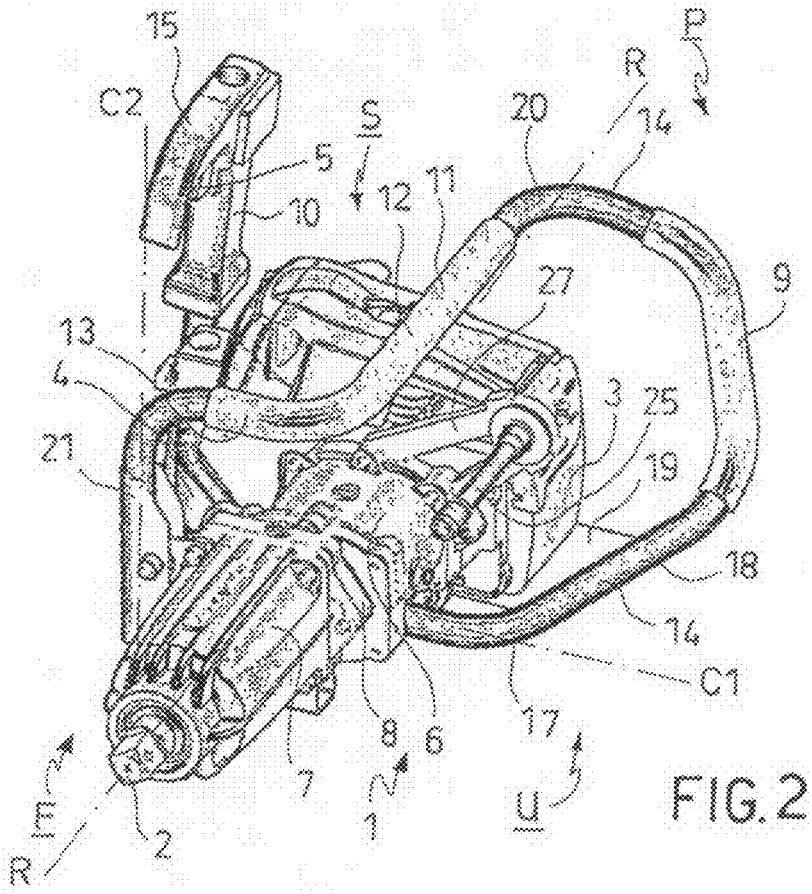
Figure 3:
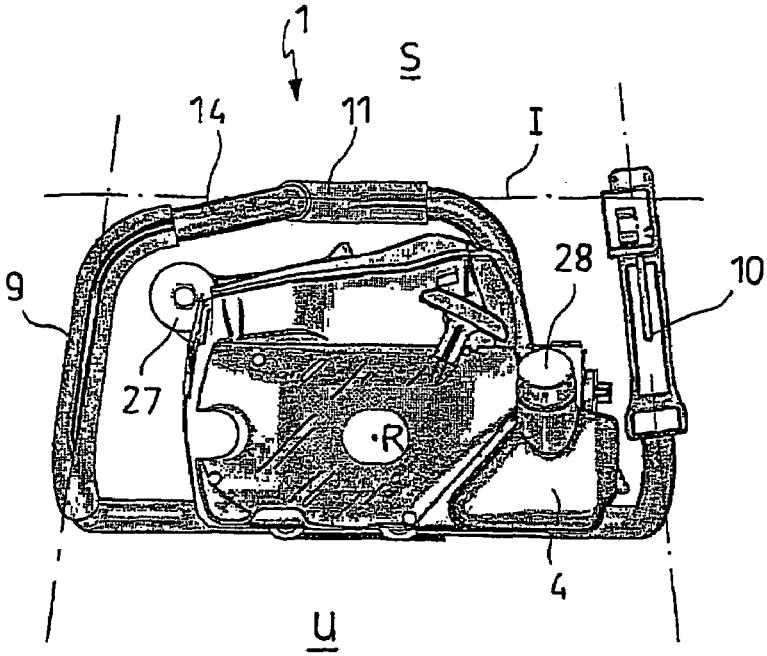
FIG. 3 is a rear view of the motorized wrench according to the invention.
Figure 4:
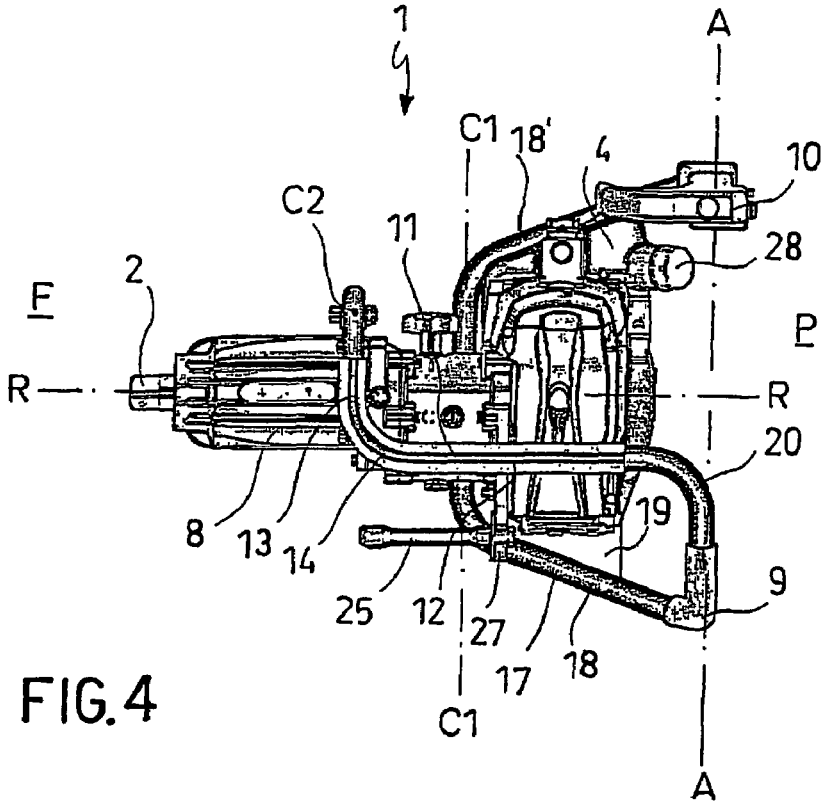
FIG. 4 is a top view of the motorized wrench according to the invention.
Figure 5:
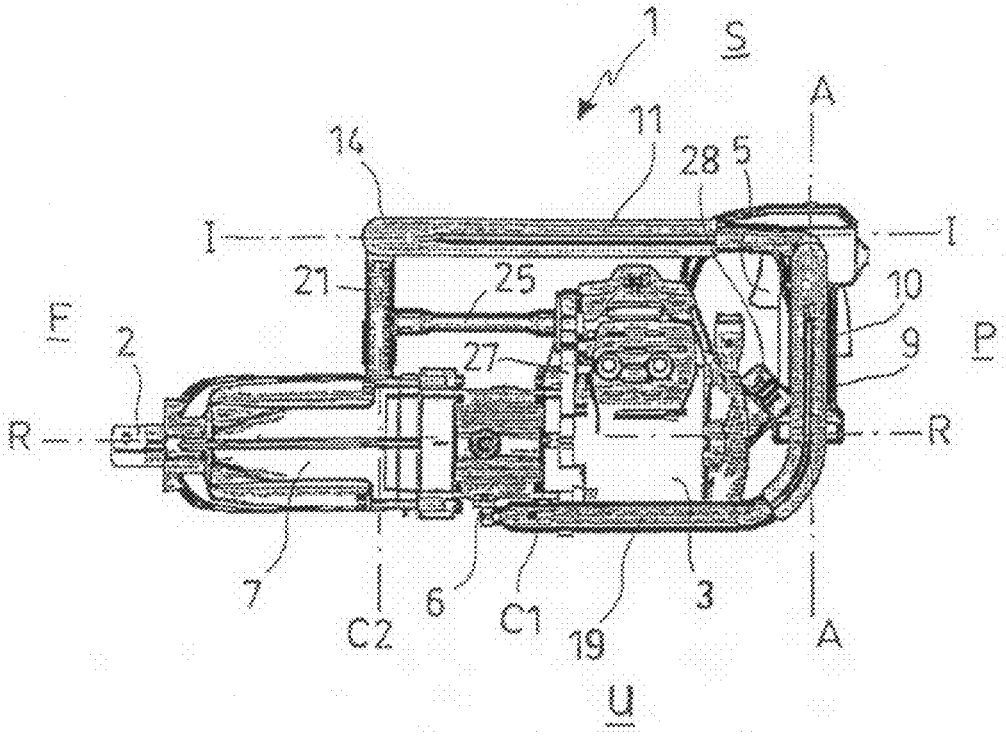
FIG. 5 is a side view of the motorized wrench according to the invention.
Figure 6:
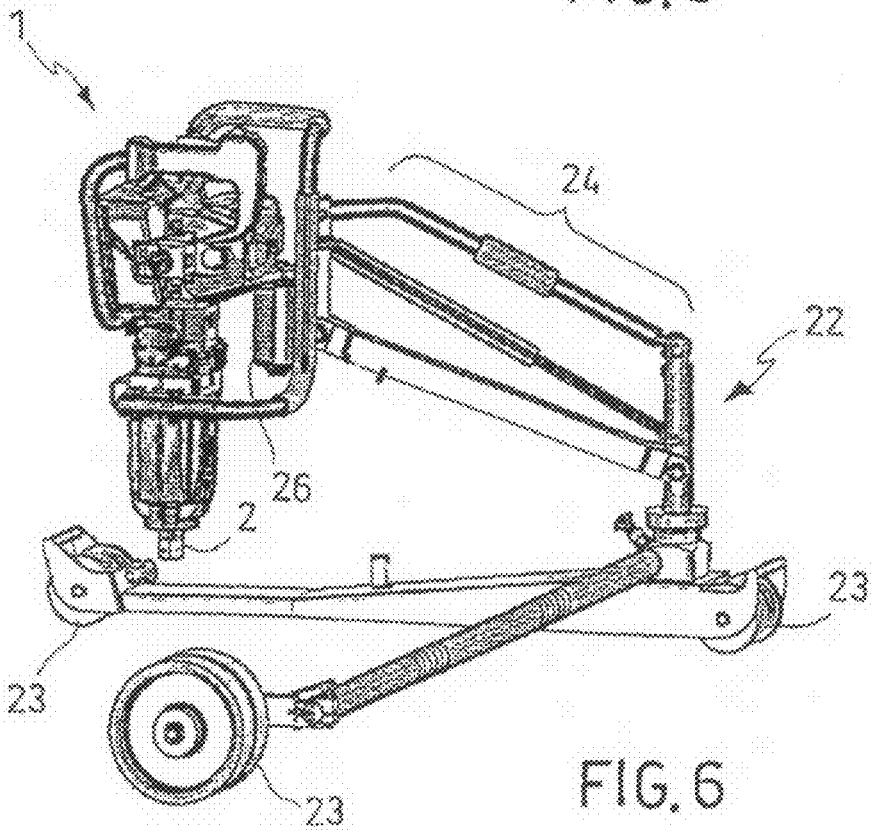
FIG. 6 is a perspective view of the motorized wrench according to the invention, as being mounted on a wrench-holding carriage.
Figure 7:
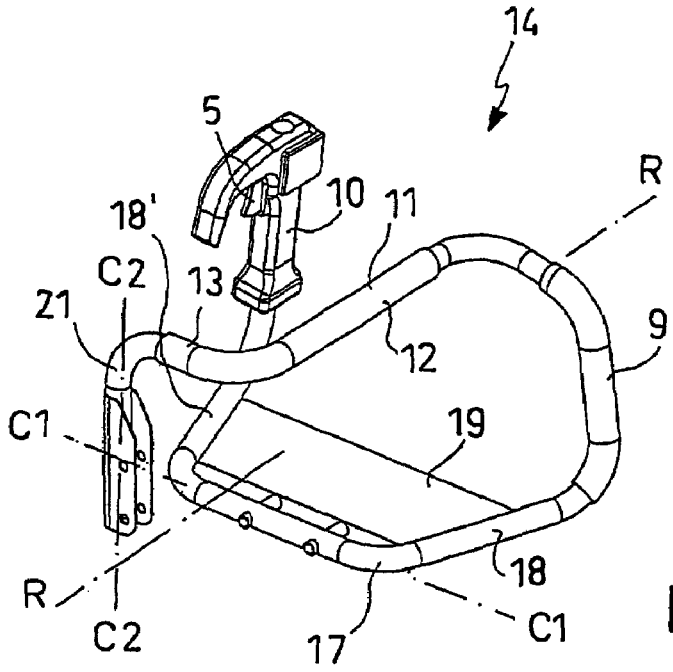
FIG. 7 is a perspective view of a detail of the motorized wrench according to the invention.

With reference to the figures, a motorized wrench (hereinafter designated as wrench) is overall indicated with numeral 1 and comprises a tool-holder shaft 2, suitable to support a bush or similar tools to engage the nuts or the screw heads to be screwed/unscrewed. The tool-holder shaft 2 is arranged on a front side F of the wrench 1 and pivotally supported around a rotation axis R.

A motor unit 3, preferably a two-stroke inner combustion motor with a fuel tank 4 is arranged on a rear side P of the wrench 1 opposite the front side F and is suitable to produce kinetic energy, particularly the rotary motion and the torque required for the screwing/unscrewing operations. Motor 3 can be operated in a controlled manner by means of a driving member, such as an accelerator button or trigger 5.

The wrench 1 further comprises a drive unit 6 with a percussion mechanism 7 arranged between the motor unit 3 and the tool-holder shaft 2. This drive unit 6, such as a reduction gear, cooperates with the motor 3 and the tool-holder shaft 2 such as to transmit the rotary motion (by transforming the angular speed and the torque) of motor 3 to the tool-holder shaft 2 to pivot the latter around the rotation axis R.

The assembly of motor unit 3, drive unit 6 and percussion mechanism 7 constitute a base body 8 of wrench 1, which develops substantially along the rotation axis R.

The wrench 1 further comprises two gripping handles 9, 10 fixed to the base body 8. The gripping handles 9, 10 are both of elongated shape and transversally spaced apart to each other relative to their longitudinal extension or, in other words, they are not arranged along the same straight line. Both gripping means 9, 10 are advantageously aligned such as to define a gripping plane A substantially tangential to both gripping handles 9, 10 and transversal to the rotation axis R.

Advantageously, the driving member 5 of motor 3 is associated to one of the two gripping handles 9, 10.

In accordance with an embodiment of the invention, the gripping plane A extends on the rear side P of wrench 1 outside the bulk of the motor unit 3 and both gripping handles 9, 10 are preferably rectilinear and lie in said gripping plane A.

Advantageously, both gripping handles 9, 10 extend along directions substantially perpendicular to the rotation axis R, which is, accordingly, normal to the gripping plane A.

In accordance with the embodiment shown in the figures, both gripping handles 9, 10 are arranged on two sides of the rotation axis R and inclined in the gripping plane A such as to get closer to each other in the direction of an upper side S of wrench A. Both gripping handles 9, 10 define between them an angle comprised between 0° and 90°, preferably between 5° and 15°, still more preferably of about 10°.

As may be seen in the figures, the wrench 1 comprises, besides both gripping means 9, 10, an auxiliary handle 11 of elongated shape, arranged on said upper side S of wrench 1. This auxiliary handle 11 is spaced apart from the gripping plane A along the rotation axis R in the direction of front side F of wrench 1.

In other words, while the gripping handles 9, 10 (defining the gripping plane A) have the same position relative to the longitudinal direction of the rotation axis R, the auxiliary handle 11 and the gripping plane A are arranged staggered along said rotation axis R.

The auxiliary handle 11 comprises a first gripping portion 12 extending substantially parallel to the rotation axis R and a second gripping portion 13 substantially parallel to the first gripping portion 12 and transversal, preferably perpendicular, to the rotation axis R.

Advantageously, the first 12 and second gripping portions 13 rest in a common gripping plane I substantially parallel to the rotation axis R and, preferably, perpendicular to the gripping plane A.

In accordance with an embodiment, the position of the auxiliary handle 11 in the longitudinal direction of the wrench 1 substantially corresponds to the position of the wrench 1 barycenter.

Advantageously, both gripping means 9, 10 and the auxiliary handle 11, 12, 13 consist of one continuous bar 14, preferably a steel or aluminum tubular section bar, tridimensionally shaped such as to extend around the rotation axis R by performing at least one 360° complete turn, as well as in the longitudinal direction of the rotation axis R.

The bar 14 is secured to the base body 8 of the wrench 1 at at least two staggered positions along the rotation axis R, i.e. along the longitudinal extension of wrench 1.

The bar 14 is anchored at both connecting positions along connecting lines C1, C2, carried out for example by means of a series of at least two screws and/or by weld beads. The connecting lines are aligned as being mutually transversal and transversal to the rotation axis R, preferably they are perpendicular to one another and perpendicular to rotation axis R.

Advantageously, the continuous bar 14 is connected to base body 8 of the wrench 1 by interposing shock absorbing elements (not shown in the figures), such as rubber bushes or washers.

One of the two gripping handles 9, 10 has a first free end 15 being one of the two free ends of the continuous bar 14 and a second end 16 rigidly connected to the other gripping handle. The driving member 5 is preferably arranged proximate to the free end 15 of the gripping means 10.

The rigid connection between both gripping handles 9, 10 takes place through a lower portion 17 of the continuous bar 14, arranged on a lower side U of wrench 1 opposite the upper side S. This lower portion U is substantially shaped as a trapezoid which is open along the major base, wherein both sides 18, 18' of trapezoid connect, at the major base, each to one of both gripping means 9, 10.

The lower portion 17 of bar 14 lies in a plane transversal to, preferably perpendicular, the gripping plane A and parallel to gripping plane I and extends immediately along the motor unit 3, particularly along the tank 4 associated thereto, thus providing impact-protection means thereof.

In accordance with an embodiment, both sides 18, 18' of the open trapezoid of the lower portion 17 of the continuous bar 14 are mutually connected through a metal plate 19 acting as a guard for the motor 3 and/or the tank 4, as well as as a resting surface for the wrench 1 in the horizontal position.

The second gripping handle 9 is connected, at the upper side S of wrench 1, to the first portion 12 of auxiliary handle 11 by means of a transition portion 20 of the continuous bar 14 extending substantially perpendicular to the first portion of handle 12 and lies in the same handle plane I.

The continuous bar 14 is secured to the base body 8 of wrench 2 by means of a bar length representing the minor base of the above trapezoidal lower portion 17, as well as by means of a connecting portion 21 being connected to the second portion of handle 13 and representing the second end of bar 14.

Advantageously, the gripping and handle areas of the gripping handles 9, 10 and handle 11 are covered with an antislip material possibly physiologically shaped, or such as plastic or rubber.

In accordance with an embodiment, the wrench 1 further comprises means for removably connecting the wrench to a suitable wrench-holder carriage 22, provided with rolls 23 for moving the carriage 22 along a rail as well as a support and positioning frame 24 for the wrench 1.

The connecting means comprise a pin, i.e. a stud 25 which extends in a substantially parallel direction to the rotation axis R and can be inserted in a support cylinder 26 of the wrench-holder carriage 22.

In accordance with a preferred embodiment, the stud 25 projects from a support bracket 27 rigidly connected to the wrench 1 and protruding therefrom in a substantially perpendicular direction to rotation axis R.

Figure 8:
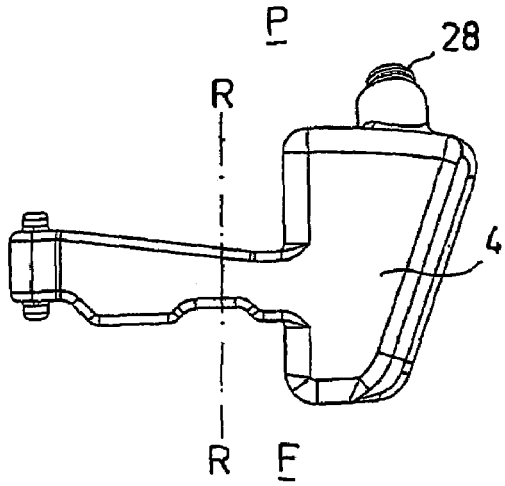
FIGS. 8 and 9 are two perpendicular views of a further detail of the motorized wrench according to the invention.
Figure 9:
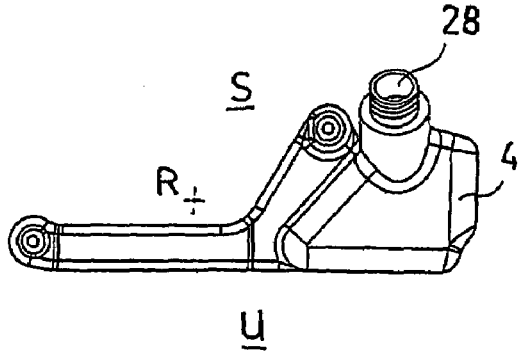

The tank 4 is formed in blown plastic material and is manufactured separately from motor unit 3 and gripping handles as well as the auxiliary handle. Advantageously, the tank 4 comprises a filler 28 arranged and oriented such as to be above the maximum filling level of the tank 4, both in the vertical operating position, such as shown in FIG. 8, and in the horizontal operating position of wrench 1, such as shown in FIG. 9.

The operation of the wrench according to the invention will be described below.

In the vertical operating position, in which the wrench front side with the tool-holder shaft normally faces downwards, for example resting on the nut of a vertical screw for anchorage of the rail couplings to the ties, the user holds the gripping means with his hands which are both in the gripping plane A.

The reaction moment employed by a user to counter the screwing/unscrewing moment has substantially the same direction as the rotation axis R, whereby deviatory moments which may cause a bad positioning of the equipment and the user's unhealthy posture are not generated. Arranging the gripping handles of the wrench rear side outside the bulk of the base body further allows the handles to be at "physiological" or ergonomical distance and inclination without increasing the wrench lateral dimensions (radial to the rotation axis R).

Arranging the control trigger on one of the two gripping handles, particularly on the handle side facing the tool-holder shaft, allows to control the operation of the wrench by the forefinger without compromising a firm grip by the hand.

In the horizontal operating position, wherein the wrench lower side with the metal plate 19 normally faces downwards and the rotation axis R is horizontal in order to unscrew/screw the bolts of the rail joints, the bar 14 and the plate 19 protect the tank 4 and motor 3 and allow the wrench to be placed for example on a tie or the ballast.

Both positioning and manual handling are facilitated by the auxiliary handle, whose position "above" the wrench barycenter allows to easily control the wrench position and prevents the risk of distorsion of the user's wrist.

The wrench, after having been positioned horizontally such that the bush engages the nut or the head of the tie joint screw, the user places himself (he sits down or crouches) behind the wrench and grips both gripping handles to operate the wrench as described above.

The wrench according to the present invention has a number of advantages. It enables the use thereof both in the horizontal and in the vertical positions, ensuring in either case that the reaction moment performed by the user acts on the same rotation axis on which the screwing/unscrewing moment acts. Consequently, the wrench according to the invention overcomes the inclination or bad positioning problems while being used and, during the rotation of the tool-holder axis, the wrench stabilizes itself automatically thanks to the gyroscopic effect. Furthermore, the wrench always favours a proper physiological posture for the user and is particularly balanced, which together with the attenuation of the vibrations on the wrench-handle connections reduces the development of health problems for the user caused by the mechanical stress on his arms.

The wrench according to the invention can be advantageously used for railway works, mounting/dismounting of truck wheels, in the oil and mining industries, in the building industry as well as for forest works and several types of emergency intervention.

Obviously, to the impact wrench according to the present invention, those skilled in the art, aiming at satisfying contingent and specific needs, will be able to carry out modifications and variants, all being contemplated within the scope of protection of the invention, such as defined by the following claims.

What is claimed is:

1. Impact motorized wrench (1) comprising:

a tool-holder shaft (2) arranged on a front side (F) of the wrench (1) and pivoting around a rotation axis (R), a motor unit (3) arranged on a rear side (P) of the wrench (1) opposite the front side (F) suitable to cause a rotary motion, an operating member (5) to operate the motor unit (3), a drive unit (6) with a percussion mechanism (7) arranged between the motor unit (1) and the tool-holder shaft (2), wherein the drive unit (6) cooperates with the motor unit (3) and the tool-holder shaft (2) such as to transmit the rotary motion from the motor unit (3) to the tool-holder shaft (2) for rotating the tool-holder shaft around the rotation axis (R) and wherein the motor unit (3), the drive unit (6) and the percussion mechanism(7) together form a base body (8) of the wrench (1), wherein the impact motorized wrench (1) comprises two gripping handles (9,10) secured to said base body (8), each of said gripping handles (9,10) having an elongated shape with a longitudinal extension, wherein said two gripping handles (9,10) are mutually transversally spaced apart relative to their longitudinal extensions, said gripping handles (9,10) being oriented such as to define a common gripping plane (A) tangential to both gripping handles (9,10), which gripping plane (A) extends transversally to the rotation axis (R) and wherein said operating member (5) is associated to one of the two gripping handles (9, 10), wherein said gripping plane (A) extends on the rear side (P) of the wrench (1) outside the bulk of the motor unit (3).

2. Motorized wrench (1) according to claim 1, wherein both gripping handles (9,10) both rest on said gripping plane (A).

3. Motorized wrench (1) according to claim 1, wherein both gripping handles (9,10) are arranged on two substantially opposing sides of the rotation axis (R).

4. Motorized wrench (1) according to claim 1, wherein both gripping handles (9,10) extend in substantially perpendicular directions to the rotation axis (R).

5. Motorized wrench (1) according to claim 1, wherein said rotation axis (R) is substantially normal to the gripping plane (A).

6. Motorized wrench (1) according to claim 1, wherein both gripping handles (9,10) are inclined toward each other in the gripping plane (A) such as to get closer to each other towards an upper side (S) of wrench (1).

7. Motorized wrench (1) according to claim 1, wherein both gripping handles (9,10) define an angle comprised between 0° and 90° therebetween.

8. Motorized wrench (1) according to claim 1, wherein both gripping handles (9,10) define an angle comprised between 5° and 15° therebetween.

9. Motorized wrench (1) according to claim 1, further comprising an auxiliary handle (11) of elongated shape arranged on an upper side (S) of the wrench (1) and having a first handle portion (12) extending substantially parallel to the rotation axis (R).

10. Motorized wrench (1) according to claim 9 wherein said auxiliary handle (11) is arranged as being spaced apart from the gripping plane (A) towards the front side (F) of wrench (1).

11. Motorized wrench (1) according to claim 9, wherein the auxiliary handle is substantially aligned in the same vertical plane as the barycentre of the wrench in the longitudinal direction.

12. Motorized wrench (1) according to claim 9, wherein said auxiliary handle comprises a second handle portion (13) substantially perpendicular to the first handle portion (12) and transversal, preferably perpendicular, to the rotation axis (R).

13. Motorized wrench (1) according to claim 12 wherein said first (12) and second handle portion (13) rest in a common handle plane (I) substantially parallel to the rotation axis (R).

14. Motorized wrench (1) according to claim 13, wherein said handle plane (I) is substantially perpendicular to the gripping plane (A).

15. Motorized wrench (1) according to claim 9, wherein the gripping handles (9,10) and the auxiliary handle are formed from one single tridimensionally shaped continuous bar (14).

16. Motorized wrench (1) according to claim 15, wherein said continuous bar (14) extends around the rotation axis (R), by performing at least one 360° complete turn while extending at the same time also in the longitudinal direction of the rotation axis (R).

17. Motorized wrench (1) according to claim 15, wherein said continuous bar (14) is secured to the base body (8) of the wrench (1) in at least two staggered positions along the rotation axis (R).

18. Motorized wrench (1) according to claim 15, wherein the continuous bar (14) is secured to the base body (8) along two connecting lines (C1, C2) transversal to the rotation axis (R).

19. Motorized wrench (1) according to claim 18, wherein both connecting lines (C1, C2) are perpendicular to each other and perpendicular to the rotation axis (R).

20. Motorized wrench (1) according to claim 19, wherein both connecting lines (C1, C2) are provided by means of a series of at least two screws or by means of a weld bead.

21. Motorized wrench (1) according to claim 15, wherein the continuous bar (14) is connected to the base body (8) through interposing shock-absorbing elements.

22. Motorized wrench (1) according to claim 15, wherein said continuous bar (14) is formed by a metal tubular section bar.

23. Motorized wrench (1) according to claim 15, wherein both gripping handles (9,10) are rigidly connected to each other through a lower portion (17) of said continuous bar (14), arranged on a lower side (U) of wrench (1) opposing the upper side (S), and substantially shaped as a trapezoid opened along the major base, wherein each one of trapezoid sides (18,18') connects, at the major base, to one of the two gripping handles (9,10).

24. Motorized wrench (1) according to claim 23, wherein the lower portion (17) of the continuous bar (14) lies in a plane perpendicular to the gripping plane (A) and parallel to the handle plane (I).

25. Motorized wrench (1) according to claim 23, wherein said lower portion (17) of the continuous bar (14) extends immediately along the motor unit (3) or a tank (4), thus providing impact-protecting means thereof.

26. Motorized wrench (1) according to claim 23, wherein both sides (18,18') of the open trapezoid of the lower portion (17) of the continuous bar (14) are mutually connected through a plate (19) acting as a protection for the motor unit (3) or the tank (4), as well as a resting surface for the wrench (1).

27. Motorized wrench (1) according to claim 1, comprising a tank (4) of a synthetic material containing fuel for the motor (3), said tank (4) being manufactured separately from the motor unit (3), the gripping handles (9,10) as well as the auxiliary handle (11).

28. Motorized wrench (1) according to claim 27, wherein the tank (4) comprises a filler (28) arranged and oriented such as to be above the maximum filling level of the tank (4), both in the vertical operating position and in the horizontal operating position of the wrench (1).

29. Motorized wrench (1) according to claim 1, further comprising removable connecting means for mounting the wrench (1) on a suitable wrench-holder carriage (22).

30. Motorized wrench (1) according to claim 29, wherein said connecting means comprise a fixing stud (25) extending in a direction substantially parallel to the rotation axis (R), which stud can be inserted in a support cylinder (26) of the wrench-holder carriage(22).

31. Motorized wrench (1) according to claim 30 wherein said stud (25) projects from a support braket (27) rigidly connected to the wrench (1) and protruding therefrom in a substantially perpendicular direction to the rotation axis (R).

32. A screwing and unscrewing system for rails, comprising:

a wrench(1) of the type comprising:

a tool-holder shaft (2) arranged on a front side (F) of the wrench (1) and pivoting around a rotation axis (R), a motor unit (3) arranged on a rear side (P) of the wrench (1) opposite the front side (F) suitable to cause a rotary motion, an operating member (5) to operate said motor unit (3), a drive unit (6) with a percussion mechanism (7) arranged between the motor unit (1) and the tool-holder shaft (2), removable connecting means for mounting the wrench (1) on a suitable wrench-holder carriage (22)

wherein the drive unit (6) cooperates with the motor unit (3) and the tool holder shaft (2) such as to transmit the rotary motion from the motor unit (3) to the tool-holder shaft (2) for rotating the tool-holder shaft around the rotation axis (R) and wherein the motor unit (3), the drive unit (6) and the percussion mechanism(7) together form a base body (8) of the wrench (1), wherein the impact motorized wrench (1) comprises two gripping handles (9,10) secured to said base body (8), each of said gripping handles (9,10) having an elongated shape with a longitudinal extension, wherein said two gripping handles (9,10) are mutually transversally spaced apart relative to their longitudinal extensions, said gripping handles (9,10) being oriented such as to define a common gripping plane (A) tangential to both gripping handles (9,10), which gripping plane (A) extends transversally to the rotation axis (R) and wherein said operating member (5) is associated to one of the two gripping handles (9, 10), wherein said gripping plane (A) extends on the rear side (P) of the wrench (1) outside the bulk of the motor unit (3), and a wrench-holder carriage (22), provided with rollers (23) for the carriage (22) to travel along a rail as well as a frame (24) for supporting and positioning the wrench (1).

33. Gripping frame for an impact motorized wrench (1) of the type comprising:

a tool-holder shaft (2) arranged on a front side (F) of the wrench (1) and pivoting around a rotation axis (R), a motor unit (3) arranged on a rear side (P) of the wrench (1) opposite the front side (F) and suitable to cause a rotary motion, an operating member (5) to operate the motor unit (3), a drive unit (6) with a percussion mechanism (7) being arranged between the motor unit (3) and the tool-holder shaft, wherein the drive unit (6) cooperates with the motor unit (3) and the tool-holder shaft (2) such as to transmit the rotary motion from the motor unit (3) to the tool-holder shaft (2) for rotating the tool-holder shaft around the rotation axis (R) and wherein the motor unit (3), the drive unit (6) and the percussion mechanism(7) together form a base body (8) of the wrench (1), wherein said gripping frame comprises two gripping handles (9,10), both of elongated shape and transversally spaced apart to each other relative to their longitudinal extensions, said gripping handles (9, 10) being oriented such as to define a common gripping plane (A) tangential to both gripping handles (9,10), wherein said gripping handles have connecting means enabling them to be attached to the base body (8) of the wrench (1) such that the gripping plane (A) extends transversally to the rotation axis (R) and wherein said operating member (5) is associated to one of the two gripping handles (9,10), wherein said gripping plane (A) extends on the rear side (P) of the wrench (1) outside the bulk of the motor unit (3).

* * * * *

UNITED STATES PATENT AND TRADEMARK OFFICE

CERTIFICATE OF CORRECTION

PATENT NO. : 7,628,220 B2
APPLICATION NO. : 11/579609
DATED : December 8, 2009
INVENTOR(S) : Barezzani et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 172 days.

Signed and Sealed this

Twenty-first Day of December, 2010

David J. Kappos

David J. Kappos
*Director of the United States Patent and Trademark Office*